United States Patent [19]

Grosz et al.

[11] Patent Number: 4,527,751

[45] Date of Patent: Jul. 9, 1985

[54] UNIVERSAL DANCER SPEED CONTROL

[75] Inventors: Edward G. Grosz, Sodus Point; F. John Herrington, Holcomb, both of N.Y.

[73] Assignee: Mobil Oil Corporation, New York, N.Y.

[21] Appl. No.: 534,930

[22] Filed: Sep. 22, 1983

[51] Int. Cl.[3] ..... B65H 25/04; B65H 59/38

[52] U.S. Cl. ..... 242/75.51; 226/44

[58] Field of Search ..... 242/75, 75.1, 75.5, 242/75.51, 45; 226/44, 45; 474/102, 109, 134, 135; 338/197, 198, 199, 153; 74/96, 553

[56] References Cited

U.S. PATENT DOCUMENTS 4,012,003 3/1977 Cochran et al. ..... 242/75.51 X 4,262,276 4/1981 Schwehr ..... 74/96 X

*Primary Examiner*—Harvey C. Hornsby

*Assistant Examiner*—Stuart J. Maltzman

*Attorney, Agent, or Firm*—Alexander J. McKillop; Michael G. Gilman; Charles J. Speciale

[57] ABSTRACT

A speed control device for a web processing machine having a dancer arm on its input. A cable connected to the dancer arm translates its movement to a cable reel of a speed control potentiometer actuator mechanism which has a variable rotary lost motion connecting device to furnish a dead band so the potentiometer does not immediately respond to every movement of the dancer arm. The cable is secured to the arm at a short distance from the arm pivot point so that a relatively small cable movement is involved.

11 Claims, 3 Drawing Figures

UNIVERSAL DANCER SPEED CONTROL

BACKGROUND OF THE INVENTION

Machinery that is used for processing a moving web, such as of paper or plastic film, must be speed-matched to the entering web. The usual method of doing this is by the use of a dancer, that is a device in which some of the length of the web is stored in a festoon. Conventionally the entering material passes over three or more stationary rollers, with the web festooning between adjacent rollers which rotate about fixed axes (so-called "stationary" rollers) and, at the bottom of the loop, passing around rollers which rotate about axes which can move in a vertical plane (so-called "movable" rollers) and are carried by a pivot arm, which moves up and down as the length of the downwardly descending loops varies in accordance with the material supply requirements of the machine. If the machine speed is too slow, the amount of stored web increases and causes the dancer to move downwardly and, when the machine speed is too fast, the amount of stored web decreases and causes the dancer to move upwardly. It is the usual practice for this dancer to be connected to a potentiometer which controls the machine speed so that an increase in the amount of stored web results in an increase in the machine speed and vice versa. Some machines are intermittent in their transport of the web, stopping the web once each cycle to perform an operation such as punching or sealing and then moving the web faster than the incoming speed to regain the lost travel. In such a machine, the dancer moves back and forth cyclically. If the potentiometer were connected directly to such a dancer, the speed would be adjusted faster and slower each cycle, resulting in excessive wear to the potentiometer and to the drive components. The usual solution to this problem is to use a dead band in connection with the potentiometer, which allows the dancer to travel within a certain limited oscillating range without movement of the potentiometer. If the dancer moves progressively in one direction more than the other, then the dead band is exceeded and a speed correction will be made.

It is common in the art to build a special potentiometer for each different machine in each different dancer. This is expensive and time consuming.

SUMMARY OF THE INVENTION

In view of the foregoing problems, it is an object of the present invention to combine a potentiometer and an actuating mechanism in the manner so that it can be used on most dancers.

It is a further object of the present invention to utilize a simple and effective method for location of a dancer which is adaptable to a variety of web processing machines.

It is a further object of the present invention to build a potentiometer actuating mechanism which is compact and simple in design so that it can be economically built and serviced and mounted in a variety of machines.

It is a still further object of the present invention to provide a potentiometer with a variable rotary lost motion connecting device so that the permissible lost motion movement of the potentiometer actuating mechanism can be varied with a simple adjustment.

Further objects and advantages of the present invention will become apparent upon a review of the following disclosure taken in conjunction with the present drawings, wherein a preferred embodiment is shown by way of illustration and not of limitation.

DESCRIPTION OF THE PREFERRED EMBODIMENT

Figure 1:
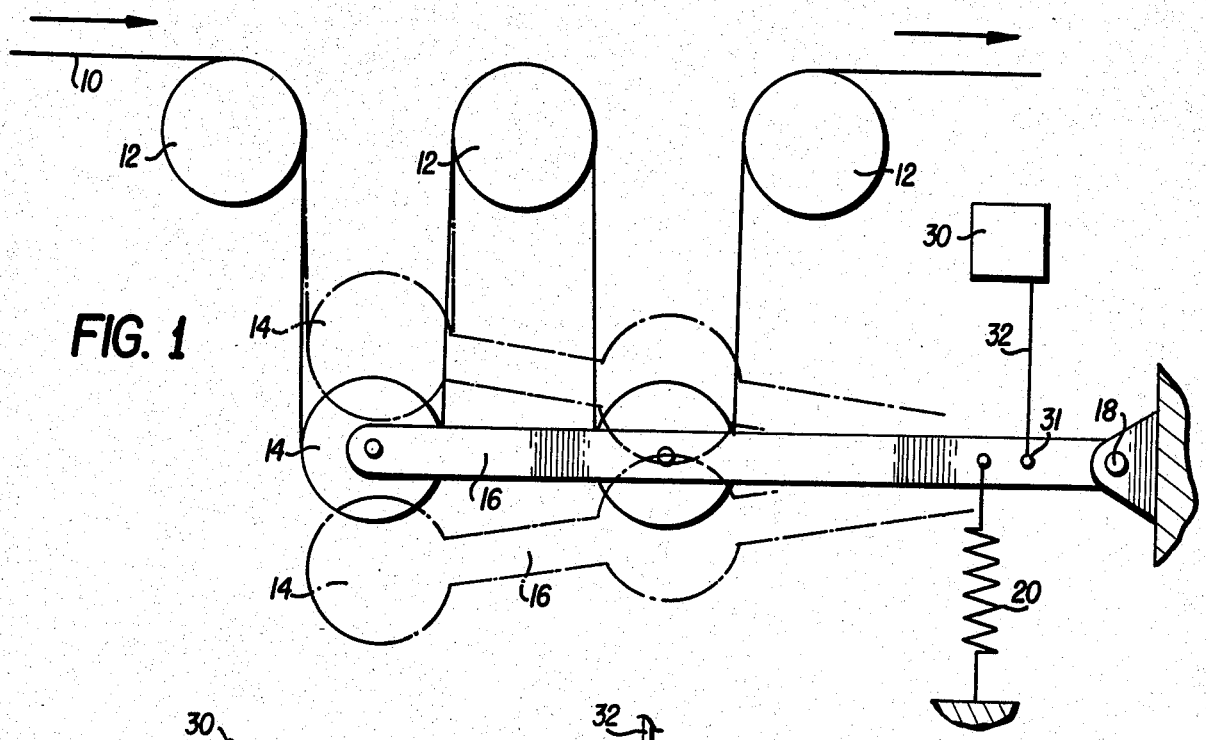
FIG. 1 is a diagramatic side view showing a web feeding toward a machine and passing over a pivotally mounted dancer arm to which is attached a speed control potentiometer actuator assembly 30, according to the present invention.

Referring now to FIG. 1, an incoming web of sheet material, such as paper or plastic, passes over stationary rollers 12 and is festooned downwardly between those rollers so as to engage movable rollers 14 which are carried by a pivotally mounted dancer arm 16. This arm is pivoted from point 18 and is downwardly biased by a spring 20. Mounted above the arm is a speed control potentiometer actuator assembly 30 according to the present invention. That assembly is connected to arm 16 by a cable 32, secured at 31 to arm 16. The position for locating assembly 30 and securement point 31 is determined as follows:

The total travel of the cable is equal to the length required to rotate the potentiometer through its full travel (about 3 inches) plus the dead band, if any. For any given machine, the assembly 30 is mounted to the frame of the machine and the cable is attached to the dancer arm at a radius at which the travel is the same as the cable travel. Regardless of the number of degrees of dancer travel, this universal control can be used by selecting the radius at which the cable is attached.

Figure 2:
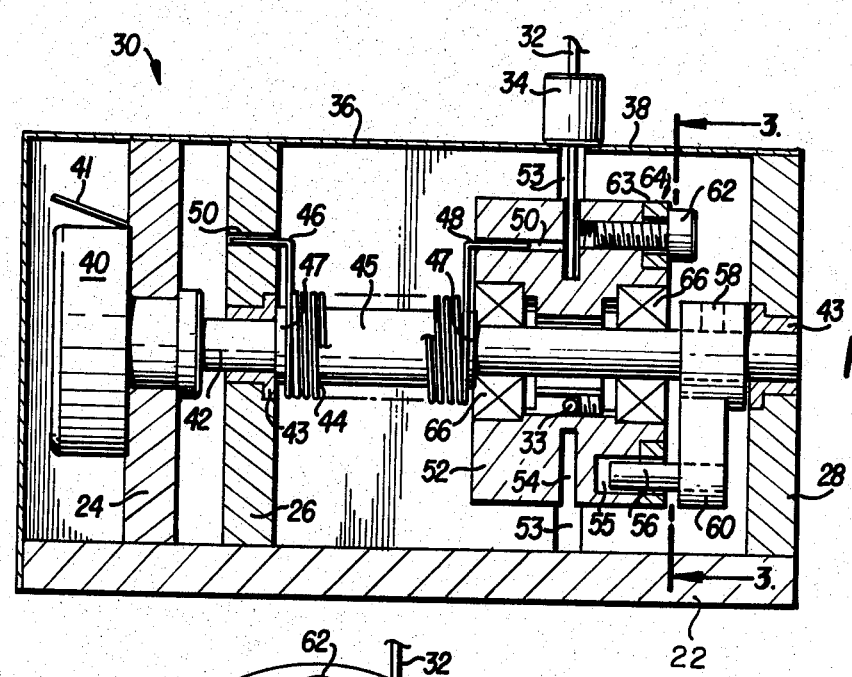
FIG. 2 is an elevational view, partly in section, of the potentiometer actuator assembly 30 of the present invention.

Attention is now directed to FIG. 2, which is a side elevational view, partly in section, of the potentiometer actuator mechanism generally designated 30. Perpendicular to a base 22, there is secured a potentiometer support wall 24, a center bearing wall 26 and an end bearing wall 28. Secured to wall 24 is the potentiometer 40, having lead wires 41 for connection to the machine to be controlled. A shaft 42 projects horizontally from the potentiometer, passing through wall 26 and into wall 28, in which walls it is rotatably supported by a pair of similar bushings 43. The shaft is of uniform diameter except for a portion 45, which is of greater diameter, so as to present shoulders 47 to bear against the complementary face of bushing 43 and bearing 66 to prevent end play in shaft 42. Wound about enlarged portion 45 is a return spring 44 having bent ends 46 and 48 which are turned into openings 50, which are located in stationary support wall 26 and in the left-hand face of reel 52. This reel has a central radially extending slot 54 for winding up a limited number of turns of cable 32. which has a movable stop member 34 adjustably secured to it by means not shown, such as a set screw.

Spring 44 is biased in a first direction, say clockwise, while cable 32 is wound about reel 52 so as to counteract that spring bias as the cable is extended. The inner end of cable 32 is secured at 33 by passing through a hole in the central part of the reel, where it is then held in place by an appropriate set screw.

In a preferred embodiment, only about three inches of cable would be payed out before the cable reaches its end and stop 34 will be positioned so that no more than three inches can be wound back into slot 54, where the cable, when wound in, would lie preferably in a single convolution.

Reel 52 is freely rotatably secured about shaft 42 by means of suitable free rolling bearings, such as ball bearings 66. Thus, the reel 52 would be free to rotate about the shaft 42, except for constraints imposed by spring 44, dog 60, and pin 56. Dog 60 is secured adjacent the right face of reel 52, as viewed in FIG. 2, and is held by set screw 58 so as to rotate with shaft 42. Pin 56 projects in the axial direction from the side of dog 60 and is received in arcuate opening 55 in the right side face of reel 52. This arcuate opening 55, in combination with pin 56, acts as a lost motion connector, with the arc being about 90°. Thus, if the initial position of pin 56 is in the center of arcuate opening 55, then reel 52 could travel about 45° or $\frac{1}{8}$ of a revolution in either direction before the end of annular slot 55 would contact pin 56 and cause rotation of shaft 42 and subsequent movement of the potentiometer.

Figure 3:
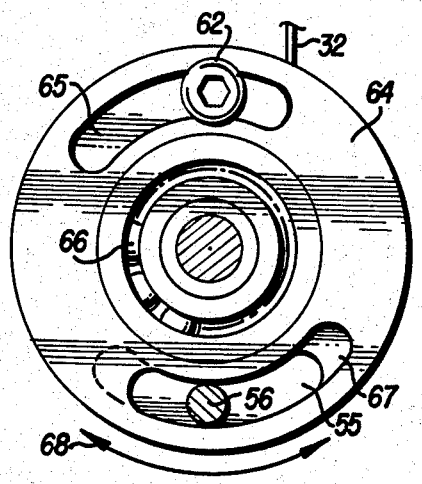
FIG. 3 is a side view, partially in section, taken along line 3—3 of FIG. 2.

The effective length of arcuate slot 55 may be varied by an annular plate 64 mounted in an annular cutout 63 on the right face of the reel. Plate 64 is detachably secured by a threaded bolt 62 which, as shown in FIG. 3, is fitted through upper arcuate slot 65 of plate 64. This plate also has a lower arcuate slot 67 which is positioned so as to be superimposed over arcuate slot 55 of reel 52. Slots 65 and 67 are preferably of the same arc and length as slot 55 so that when bolt 62 is in the center of slot 65, the pin 56 is free to travel the entire 90° arc. However, if bolt 62 is loosened and plate 64 is rotated in relation to reel 52, then the effective length of slot 55 will be shortened, as shown in FIG. 3.

Since plate 64 can be rotated in either direction, as shown by arrow 68 in FIG. 3, the length of slot 55 can be effectively shortened on either the "leading" or the "trailing" end thereof. Thus, after the location of assembly 30 has been selected so as to be positioned above point 31, where there will be approximately three inches of normal travel, it is still possible to "fine tune" the mechanism of the present invention by merely removing right housing half 38 to gain access to screw 62. The annular plate 64 can then be rotated in either direction to decrease the arcuate movement of reel 52 in relation to pin 56. Obviously, the plate 64 can be rotated to the extent that the effective length of slot 55 will be decreased down to the point where it is equal to the diameter of pin 56. At that point, there is no lost motion in the connection and any rotation of reel 52 will directly affect potentiometer 40.

The present device is readily serviceable by removal of left housing half 36 or right housing half 38, which are conveniently arranged so as to define a slot 53 which extends around three sides of the device so that cable 32 can readily be payed out in one of those directions, leading to greater ease in installation and variation of location sites.

We claim:

1. A speed control potentiometer actuator mechanism for controlling a machine comprising:

a shaft mounted for rotation and drivingly connected to a potentiometer;

a variable lost motion connection device connected to said shaft to rotate it in a first direction in accordance with a variable movement of the machine controlled by the potentiometer, the lost motion connecting device comprises a reel for winding a tension transfer means for connecting to the machine to be controlled, said reel having a variable length first arcuate slot engaged by a pin connected to said shaft for rotation therewith, the arcuate slot being positioned to engage the pin at one end of said slot and thus to rotate the shaft and the potentiometer;

resilient biasing means connected to said lost motion connecting device to rotate it in a second opposite direction.

2. The mechanism of claim 1, in which the tension transfer means is a cable secured at one end to said reel and said arcuate slot is on one end face of said reel, with the pin projecting from a dog extending generally parallel to said end face.

3. The mechanism of claim 3, in which said first arcuate slot is in a circular plate detachably secured to the end face of the reel by a bolt passing through a second arcuate slot in said plate.

4. The assembly of claim 3, in which the cable extends away from the reel for attachment to a dancer pivot arm of a web processing machine.

5. The assembly of claim 4, in which the cable has a stop means thereon to limit the amount of cable wound on said reel.

6. The device of claim 1, in which said reel is mounted for free rotation about the potentiometer shaft.

7. The device of claim 6, in which the resilient biasing means is a spring wound about said potentiometer shaft, with one end connected to said reel and the other end connected to a stationary part of the device.

8. The device of claim 7, in which the potentiometer is at one end of the shaft and the dog is adjacent the opposite end of the shaft, with the cable reel and spring mounted therebetween on said shaft.

9. A speed control potentiometer actuator assembly comprising:

a potentiometer mounted at one end of an elongated housing and having a shaft extending therefrom to the opposite end of the housing and mounted for rotation within the housing;

a cable reel mounted on said shaft for free rotation thereabout and spaced from said potentiometer;

a spring wound about but not connected to said shaft between said potentiometer and said reel, said spring being connected to one side of said reel to bias it in a first direction of rotation;

a plate detachably mounted to the other side of said reel, said plate having a first arcuate opening through which passes a bolt securing the plate to the reel;

a second arcuate opening in said plate generally diametrically opposite said first arcuate opening;

a dog secured to said shaft adjacent to said other side of said reel for rotation with said shaft and having a pin projecting into said second arcuate opening of said plate so that when said reel rotates sufficiently to move said pin and rotate said dog and shaft, the potentiometer will be adjusted accordingly.

10. The assembly of claim 9, in which one portion of the shaft is of enlarged diameter to form shoulders for contacting adjacent surfaces to limit shaft end play.

11. A universal dancer speed control for a web processing machine having at least one electric drive motor comprising:

at least two rollers mounted for rotation about stationary axes and at least one roller mounted for rotation about an axis carried by a movably mounted dancer arm;

a cable connected to said dancer arm at a preselected distance from said movable mount;

means for adjusting the speed of said drive motor in accordance with the movement of said dancer arm, including a potentiometer having a shaft mounted for rotation and connected to said cable and a reel for said cable;

a variable lost motion connecting device connected to said shaft to rotate it in a first direction in accordance with a variable movement of said cable, said lost motion connecting device comprising said reel having a variable length first arcuate slot, a pin engaging said slot and connected to said shaft for rotation therewith, the slot being positioned to engage the pin at one end of said slot and thus to rotate the shaft and the potentiometer;

resilient biasing means connected to said lost motion connecting device to rotate it in a second opposite direction.

* * * * *